United States Patent [19]

Andersson

[11] 4,303,113

[45] Dec. 1, 1981

[54] CUTTING TOOL

[75] Inventor: Bengt A. Andersson, Halmstad, Sweden

[73] Assignee: Maskinfabriken Waco AB, Halmstad, Sweden

[21] Appl. No.: 140,001

[22] Filed: Apr. 14, 1980

[30] Foreign Application Priority Data

May 10, 1979 [SE] Sweden ..... 7904092

[51] Int. Cl.[3] ..... B26D 1/12

[52] U.S. Cl. ..... 144/230; 144/241; 407/47; 407/49

[58] Field of Search ..... 144/218, 230, 241; 407/40, 41, 42, 47, 49, 102, 108

[56] References Cited

U.S. PATENT DOCUMENTS 1,411,799 4/1922 Miller ..... 407/40

3,887,975 6/1975 Sorice et al. ..... 407/47

FOREIGN PATENT DOCUMENTS 2301346 2/1975 France ..... 144/230

*Primary Examiner*—W. D. Bray

*Attorney, Agent, or Firm*—Holland, Armstrong, Wilkie & Previto

[57] ABSTRACT

The disclosure relates to a tool consisting of a tool body and cutter bits which are each secured in a slot in the body. By means of a tension screw which engages with the end portion of the bit located most proximal the bottom of the slot, the bit is fixedly retained in the slot under the application of a torque, the bit engaging with the slot walls at, in particular, three points; namely a point on the chipping face of the bit above a clearance disposed between this face and the slot face adjacent the bottom of the slot, a point on the rear face of the bit adjacent the periphery of the tool body, and, finally, the bottom of the slot. The tension screw engages with a surface on the bit which is located beneath a plane at right angles to the longitudinal direction of the bit through the abutment point on the chipping face of the bit, the surface preferably making an angle of approximately 45° with this plane.

6 Claims, 1 Drawing Figure

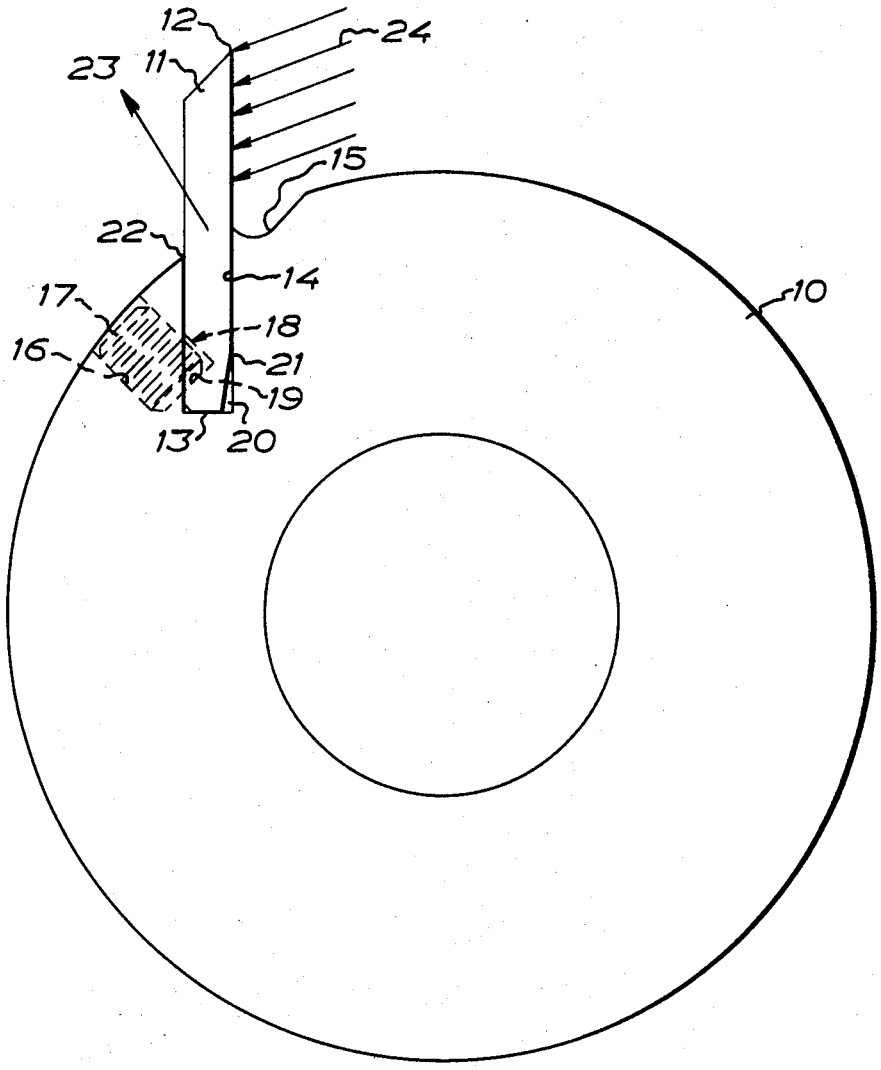
12
24
23
11
15
22
14
10
17
18
16
21
19
13
20

CUTTING TOOL

The present invention relates to a tool consisting of a body provided at its peripheral surface with slots for the detachable securing of cutter bits.

Profile steel cutters with replaceable bits are common within, for example, the woodworking industry. Great demands are placed on the securing of the bits in the tool body, since the bits must first be able to withstand the extremely great forces which are exerted on them when the cutter rotates at high speed, and secondly the cutting edges of the cutters should be at exactly the same distance from the centre of rotation of the cutter. This latter circumstance is necessary in order to limit the requisite equalization or repointing of the assembled cutter and to allow for removal and remounting of cutter bits. Normally, the bits are securely mounted by being placed in recesses in the tool body, the recesses having a trailing wall with respect to the contemplated direction of rotation, against which trailing wall the rear face of the cutter bit is urged by a clamping means which engages with the chipping face of the bit and the leading wall of the recess. Moreover, in most cases use is made of some form of adjustment screw which engages with the rear face of the bit. The use of such an apparatus ensures that the cutter is securely retained in a satisfactory manner with similarly satisfactory precision. However, this securing and adjustment work is circumstantial and time-consuming.

The object of the present invention is to improve the retention of the bits and to increase the capacity of the bit to withstand forces which are exerted on it while, at the same time, making possible more accurate adjustment in a considerably simpler manner than has hitherto been possible. This object is achieved according to the invention in that each bit is clampable by clamping means against the defining surfaces of the slot or recess, in particular at one point on the chipping face of the bit and at one point on the rear face of the bit, of which points that on the chipping face is located closer to the centre of the tool body than the point on the rear face, and against the bottom of the slot.

Preferably, the slot is of substantially the same configuration and dimensions as that portion of the bit which is insertable with snug fit into the slot, and clearance is provided at the bottom of the slot between the chipping face of the bit and the wall of the slot, the above-mentioned point of abutment on the chipping face being located immediately above the upper limit of this clearance, whereas the point of abutment on the rear face is located adjacent the periphery of the tool body. By means of this arrangement, it is possible, with the assistance of clamping means in the form of a screw member which may be actuated from outside the tool body and engages with the rear face of the bit in the vicinity of the lower end of the bit, to subject the bit to torque such that the bit is urged against, in particular, the above-mentioned points of abutment and the bottom of the slot, and in this way realize very secure retention at the same time as the accuracy of the retention is increased considerably in comparison with prior art arrangements. The bits are secured in a very simple manner by tightening of the screw which acts upon the rear face of each bit, whereby assembly of a cutter, as well as replacement of a bit, can be effected rapidly even by a person who is not skilled in the art.

The invention will be described in greater detail below with reference to the accompanying drawing which is a side elevation of one embodiment of the tool according to the invention.

The drawing shows a cutter having a tool body 10 and a cutter bit 11 which is secured in the body 10 in that it intrudes, throughout a portion of its length, into a slot 14 provided in the body 10, the slot having a bottom 13. Even though, for purposes of clarity, but a single bit 11 is shown on the drawing, it will be obvious to the skilled reader that a plurality of such bits is distributed around the periphery of the body 10. The bit 11 has an edge 12 and, ahead of the bit 11, the body is provided, in the conventional manner, with a breaker portion 15. The bit 11 and slot 14 are, for the most part, of the same cross-sectional configuration and dimension, and the bit 11 is insertable with snug fit into the slot 14. A threaded passage 16 is provided behind the bit 11 in the contemplated direction of rotation of the cutter, a screw 17 being threadable in the passage into engagement with the lower end portion of the bit 11. For engagement with this screw, the bit 11 is provided on its rear face with a recess 18 having a lower defining surface 19 which, for engagement with the inner end surface of the screw 17, extends in parallel therewith, and an upper surface at right angles to the lower surface, as shown on the drawing. The recess 18 may be formed either by a bore of arcuate cross-section or by a groove extending transversely of the width of the bit, that is to say at right angles to the plane of the drawing. The bit 11 is bevelled adjacent its lower or inner end so as to form a clearance at 20. This clearance 20 which is of importance for the retention of the bit 11, can also, naturally, be located in the wall of the slot adjacent the bottom of the slot and opposite the bevelling of the bit 11 as shown on the drawing. The bit 11 and slot 14 are manufactured with accurate tolerances.

The illustrated embodiment entails a number of advantages. First and foremost, mounting of the bit in the tool body 10 is very simple, since the bit is quite simply inserted into the slot 14 whereupon the screw 17 is tightened. Thanks to the illustrated arrangement the bit will be subjected to torque and be urged against three well-defined points, namely the point 21 on the chipping face of the bit 11 directly above the clearance 20, the point 22 on the rear face of the bit 11 adjacent the periphery of the body 10, and, finally the bottom 13 of the slot 14. However, this presupposes that the screw 17 engages in a suitable manner with the lower end of the bit, it having proved that the best result is obtained if the lower surface 19 of the recess 18 is located below a plane through the point 21 on the chipping face of the bit, this plane making a right angle with the longitudinal axis of the bit 11. Moreover, this surface 19 should make an acute angle with the plane through the point 21, preferably an angle of approximately 45°.

As a result of the above-mentioned securing of the bit 11 in the slot 14 by torque, the desired accurate retention of the bit 11 in the tool body 10 will be attained in an extremely simple manner. Moreover, the points 21 and 22 form the natural torque points for the cutting loading which is intimated on the drawing by means of a number of arrows 24, and for the centrifugal force which is shown by means of the arrow 23, whereby the position of the bit while in use will be definitely fixed.

Above the point 21 and below the point 22, the bit 11 abuts directly against large surfaces of the tool body, which assists in the transfer of forces from the bit to the tool body. Because of this direct surface-to-surface contact between the bit and the tool body, "settling" is avoided, which otherwise might occur when the bit is secured in place by means of wedges or clamping means between the bit and the force absorption surfaces of the tool body.

The drawing shows a cutter which is particularly intended for woodwork, but it is obvious that the invention may also be applied to other forms of wood or metal working tools which are provided with replaceable bits. If the dimension of the bit 11 in the longitudinal direction of the cutter exceeds a certain limit, several screws 17 must, naturally, be used.

What I claim and desire to secure by Letters Patent is:

1. A tool comprising:

a tool body, said tool body having slots therein, said slots are provided with a bottom and are disposed in the periphery of said tool body; said slots having front and rear defining surfaces;

cutter bits detachably secured in said slots in the periphery of said tool body; said bits being provided with a chipping face and a rear face; and clamping means for fixedly clamping said bits in said slots, each bit being provided with a clamping means which is adapted, on actuation, to urge said bit against the said defining surfaces of the slot at one point on the chipping face of said bit and at one point on the rear face of said bit and against the bottom of the slot, the point on said chipping face being located closer to the centre of the tool body than the point on said rear face.

2. The tool as recited in claim 1, in which said slot is of substantially the same configuration and dimensions as the portion of the bit which is insertable in said slot, clearance being provided at the bottom in said slot between the chipping face of said bit and the slot wall, the point of abutment on said chipping face being located immediately above the upper limit of said clearance, whereas the point of abutment on said rear face is located adjacent the periphery of said tool body.

3. The tool as recited in claim 2, in which the chipping face of said bit is bevelled adjacent the lower end thereof to provide said clearance.

4. The tool as recited in claims 1, 2, or 3, in which said clamping means consists of a screw member actuable from the outside of the tool body and engaging with the rear face of said bit in the vicinity of the lower end thereof.

5. The tool as recited in claim 4, in which said bit has, on its rear face, a recess with a lower, planar surface intended for engagement with said clamping means, said surface being located in its entirety below a plane at right angles to the longitudinal direction of said bit through the point of abutment on the chipping face of said bit, and making an acute angle with said plane.

6. The tool as recited in claim 5, in which the angle between said plane and the engagement surface of said screw member is 45°.

* * * * *